US009945082B2

(12) United States Patent
Connell et al.

(10) Patent No.: US 9,945,082 B2
(45) Date of Patent: Apr. 17, 2018

(54) BOLLARD BASE

(71) Applicant: Illinois Tool Works Inc., Glenview, IL (US)

(72) Inventors: Robert Urquhart Connell, Atlanta, GA (US); Jeffrey R. Juskowich, Mableton, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/281,833

(22) Filed: Sep. 30, 2016

(65) Prior Publication Data

US 2017/0101750 A1 Apr. 13, 2017

Related U.S. Application Data

(60) Provisional application No. 62/239,030, filed on Oct. 8, 2015.

(51) Int. Cl.

| | |
|---|---|
| ***E04H 12/22*** | (2006.01) |
| ***E01F 9/685*** | (2016.01) |
| ***E02D 27/42*** | (2006.01) |

(52) U.S. Cl.

CPC ..... *E01F 9/685* (2016.02); *E02D 27/42* (2013.01); *E04H 12/2284* (2013.01)

(58) Field of Classification Search

CPC ..... E01F 9/685; E01F 9/617; E04H 12/2284; E02D 27/42; E02D 27/50

See application file for complete search history.

(56) References Cited

U.S. PATENT DOCUMENTS 3,036,401 A * 5/1962 Stark ..... A47B 91/024 248/188.4
3,110,982 A * 11/1963 Besinger ..... B28B 23/02 52/283

(Continued)

FOREIGN PATENT DOCUMENTS

DE 7244545 U 5/1973
DE 2264431 A1 4/1974

(Continued)

OTHER PUBLICATIONS

PNA Construction Technologies, "Bollard Base: Make Bollard Installation Quick, Inexpensive and Precise", 2010 (1 page).

(Continued)

*Primary Examiner* — Brent W Herring
(74) *Attorney, Agent, or Firm* — Neal, Gerber & Eisenberg LLP

(57) ABSTRACT

Various embodiments of the present disclosure provide a bollard base including a top plate, a plurality of spaced-apart anchors each integrally connected to and extending downwardly from the top plate, a plurality of adjustable leg assemblies at least partially connected to the top plate, and a tubular baffle connected to and extending downwardly from the bottom of the top plate, wherein the plurality of adjustable leg assemblies include a plurality of spaced-apart tubular legs integrally connected to and extending downwardly from the top plate, and a plurality of adjustable feet respectively partially insertable into the tubular legs. Various embodiments of the present disclosure also provide a bollard base including a top plate and a tubular baffle connected to and extending downwardly the top plate.

42 Claims, 9 Drawing Sheets

(56) References Cited

U.S. PATENT DOCUMENTS 3,150,853 A * 9/1964 Lisbin ..... A47B 91/024 248/188.4
4,241,789 A * 12/1980 Grosch ..... E21B 17/00 138/113
4,313,586 A * 2/1982 Grzesnikowski .... A47B 91/024 248/188.4
4,359,848 A * 11/1982 Haeussler ..... B28B 23/028 428/119
4,785,593 A 11/1988 Munoz, Jr.
5,169,259 A * 12/1992 Cornell, Jr. ..... A47B 91/024 248/188.4
5,505,033 A * 4/1996 Matsuo ..... E04H 12/2261 52/169.9
5,819,487 A * 10/1998 Bull ..... E02D 27/42 52/295
6,327,985 B1 * 12/2001 Frenkler ..... A47B 9/00 108/147.19
6,503,024 B2 * 1/2003 Rupiper ..... E02D 35/00 405/229
6,536,725 B2 * 3/2003 Fisher ..... A47B 91/12 248/188.4
6,805,515 B2 * 10/2004 Reale ..... E01F 13/04 404/11
7,507,050 B2 * 3/2009 McCue ..... E01F 15/0469 404/6
7,507,051 B2 3/2009 McCue et al.
7,614,200 B2 * 11/2009 Wobben ..... E02D 27/42 248/125.8
7,900,406 B2 * 3/2011 Wobben ..... E02D 27/42 248/156
7,901,156 B2 3/2011 McCue et al.
D646,404 S 10/2011 Hild et al.
8,161,698 B2 * 4/2012 Migliore ..... E02D 27/42 52/169.9
8,376,650 B2 2/2013 Hild et al.
8,444,343 B2 5/2013 McCue et al.
8,684,571 B1 * 4/2014 Alaura ..... F21S 8/083 362/431
8,763,329 B2 * 7/2014 Moseid ..... E04B 1/483 52/126.1
8,915,670 B2 12/2014 Ustach et al.
8,931,937 B2 * 1/2015 Alaura ..... F21S 8/083 362/431
9,003,721 B1 * 4/2015 Jensen ..... E02D 27/425 52/126.1
9,127,422 B2 * 9/2015 Ball ..... E01F 13/12
9,328,470 B2 * 5/2016 Berto ..... E01F 13/046
9,518,402 B1 * 12/2016 Kundel, Sr. ..... E02D 27/42
2004/0175231 A1 * 9/2004 Reale ..... E01F 13/04 404/6
2006/0157631 A1 * 7/2006 Cunningham ..... E01F 9/685 248/545
2007/0248410 A1 10/2007 McCue et al.
2008/0187396 A1 * 8/2008 McCue ..... E01F 15/141 404/6
2008/0190058 A1 * 8/2008 Migliore ..... E02D 27/42 52/295
2008/0304909 A1 12/2008 McCue et al.
2009/0035061 A1 * 2/2009 Crawford ..... E01F 13/026 404/6
2010/0172692 A1 7/2010 McCue et al.
2012/0011800 A1 * 1/2012 Moseid ..... E04B 1/483 52/741.15
2012/0251236 A1 10/2012 Hild et al.
2012/0301219 A1 11/2012 McCue et al.
2014/0017003 A1 * 1/2014 Ball ..... E01F 13/12 404/6
2014/0153224 A1 * 6/2014 Alaura ..... F21S 8/083 362/145
2014/0154007 A1 6/2014 Ustach et al.
2014/0340244 A1 * 11/2014 Bischoff ..... G08G 1/005 340/944
2015/0050084 A1 * 2/2015 Berto ..... E01F 13/046 404/6
2015/0225910 A1 * 8/2015 Bleile ..... E01F 9/013 404/6
2017/0030045 A1 * 2/2017 Krause ..... E02D 27/425

FOREIGN PATENT DOCUMENTS

EP 0565429 A1 10/1993
EP 0 952 265 10/1999
FR 2723112 A1 2/1996
GB 2463184 3/2013
JP 2005320720 A * 11/2005
WO WO2006026441 A2 3/2006
WO WO 2007091977 A1 * 8/2007 ..... E01F 13/12
WO WO2006026441 A3 1/2008
WO WO2008137040 11/2008
WO WO2008154568 12/2008
WO WO2009091486 7/2009
WO WO2009155112 12/2009

OTHER PUBLICATIONS

PNA Construction Technologies, "Bollard Base: Simple and Flexible Bollard Installation", 2010 (1 page).
PNA Construction Technologies, "Suggested Master Specification: Bollard Base", Aug. 2006 (2 pages).
PNA Round Bollard Base—17¾" Figure, Jan. 2007 (1 page).
PNA Square Bollard Base—16" 3-View Figure, Aug. 2007 (1 page).
PNA Square Bollard Base—24" 3-View Figure, Aug. 2007 (1 page).
European Patent Office as International Searching Authority, Invitation to Pay Additional Fees and, Where Applicable, Protest Fee with Annex to Form PCT/ISA/206 Communication Relating to the Results of the Partial International Search, dated Jan. 9, 2017, in corresponding Application No. PCT/US2016/055325 (8 pages).
European Patent Office as International Searching Authority, International Search Report and Written Opinion, dated Mar. 8, 2017, in corresponding Application No. PCT/US2016/055325 (20 pages).

* cited by examiner

BOLLARD BASE

PRIORITY CLAIM

This application claims priority to and the benefit of U.S. Provisional Patent Application Ser. No. 62/239,030, filed Oct. 8, 2015, entitled "BOLLARD BASE," the entire contents of which are incorporated herein by reference.

BACKGROUND

Protective bollards are well known and widely used throughout industrial buildings, warehouses, and other commercial buildings to protect objects, property, and people. Bollards often include a simple steel post that is positioned adjacent to an area the object or property is in or an area that a person may be in to protect the objects, property, and/or people in the area from damage or injury. Bollards often protect objects such as utilities, electronics, machinery, buildings, shelving, doors, entry ways and pedestrians from accidental collisions with vehicles such as forklift trucks.

Bollard bases (such as the known commercially available bollard base shown in FIG. 1) are also well known and have been widely used in the construction industry and the concrete flooring industry for the installation of bollards in and around buildings such as warehouses. The known bollard base 10 shown in FIG. 1 is configured to be placed on a sub-grade (not shown in FIG. 1) before the concrete (not shown in FIG. 1) of the floor (not shown in FIG. 1) is poured. More specifically, this known bollard base 10 includes a solid cylindrical steel top plate 12, a solid cylindrical steel bottom plate 14, a plurality of steel anchors 16 extending downwardly from the top plate 12, and a centrally positioned steel cylindrical tube 18 integrally connected to and extending between the top surface of the bottom plate 14 and the bottom surface of the top plate 12. The bottom surface of the bottom plate 14 is placed on the sub-grade before the concrete of the floor is poured. The concrete is then poured such that, in an ideal scenario, the top surface of the top plate of the bollard base is level or substantially level with the top surface of the poured concrete. After the poured concrete hardens, since the top surface of the top plate 12 of this known bollard base 10 is exposed, a bollard can be welded to the top surface of the top plate 12. If the bollard is later damaged but the bollard base 10 is not damaged, the damaged bollard (and associated welding) can be cut or ground off this bollard base 10 and a new bollard can be attached to this bollard base 10.

One known problem with this type of known bollard base is that it is not adjustable. If the sub-grade is not of the exact specified height or not within allowed tolerances or is not level or substantially level, when the bollard base is placed on the sub-grade, the top surface of the top plate of the bollard base may not be on the same level as the top surface of the concrete floor after the concrete is poured. To address such situations, such bollard bases are sometimes raised and/or leveled using one or more shims or wedges.

Another known problem with this type of known bollard base is that it does not enable air to escape when the concrete is poured around this bollard base. Air becomes trapped under the top plate and voids under this top plate are created.

Another known problem with this type of known bollard base is that it requires extensive pre-planning of the bollard base based on the exact thickness of the concrete. In other words, this known bollard base must be made to certain dimensions to account for different thicknesses of the concrete floors. This requires extensive pre-planning and ordering of the bollard bases and that the different bollard bases be manufactured for different construction projects.

Accordingly, there is a need for new bollard bases that solve the above problems.

SUMMARY

Various embodiments of the present disclosure provide a bollard base that solves the above problems.

In various embodiments, the bollard base of the present disclosure includes a top plate and a plurality of adjustable leg assemblies partially integrally connected to the top plate. In various embodiments, the plurality of adjustable leg assemblies include a plurality of spaced-apart tubular legs integrally connected to and extending downwardly from the top plate, and a plurality of adjustable feet respectively removably partially insertable into the tubular legs. The adjustable leg assemblies enable the height of the bollard base on a sub-grade to be adjusted. They also enable the bollard base to be level on a sub-grade which is not level. They further enable the bollard base to be used for different concrete thicknesses.

In various embodiments of the present disclosure, the bollard base with the adjustable leg assemblies further includes at least one and preferably a plurality of spaced-apart anchors (such as anchoring bars) each connected to and extending downwardly from the top plate.

In various embodiments, the bollard base of the present disclosure includes a top plate and a tubular baffle integrally connected to and extending downwardly from the bottom surface of the top plate. The body of the tubular baffle defines a plurality of spaced apart openings which enable concrete poured on the sub-grade to flow through the spaced apart openings in the baffle to provide a secure engagement between the bollard base and the concrete. The top plate and the tubular baffle also enable trapped air to be released through the top plate during the compaction process. The top plate and the tubular baffle further prevent vacuum pockets from forming under the top plate during the curing process.

In various embodiments, the bollard base of the present disclosure with the top plate and the tubular baffle further includes at least one and preferably a plurality of spaced-apart anchors each connected to and extending downwardly from the top plate.

In various embodiments, the bollard base of the present disclosure with the top plate and the tubular baffle further includes a plurality of adjustable leg assemblies partially integrally connected to the top plate.

In various embodiments, the bollard base of the present disclosure with the top plate and the tubular baffle further includes a plurality of adjustable leg assemblies partially integrally connected to the top plate and at least one and preferably a plurality of spaced-apart anchors each connected to and extending downwardly from the top plate.

Additional features and advantages of the present invention are described in, and will be apparent from, the following Detailed Description and the Figures.

DETAILED DESCRIPTION OF EXAMPLE EMBODIMENTS

Figure 1:
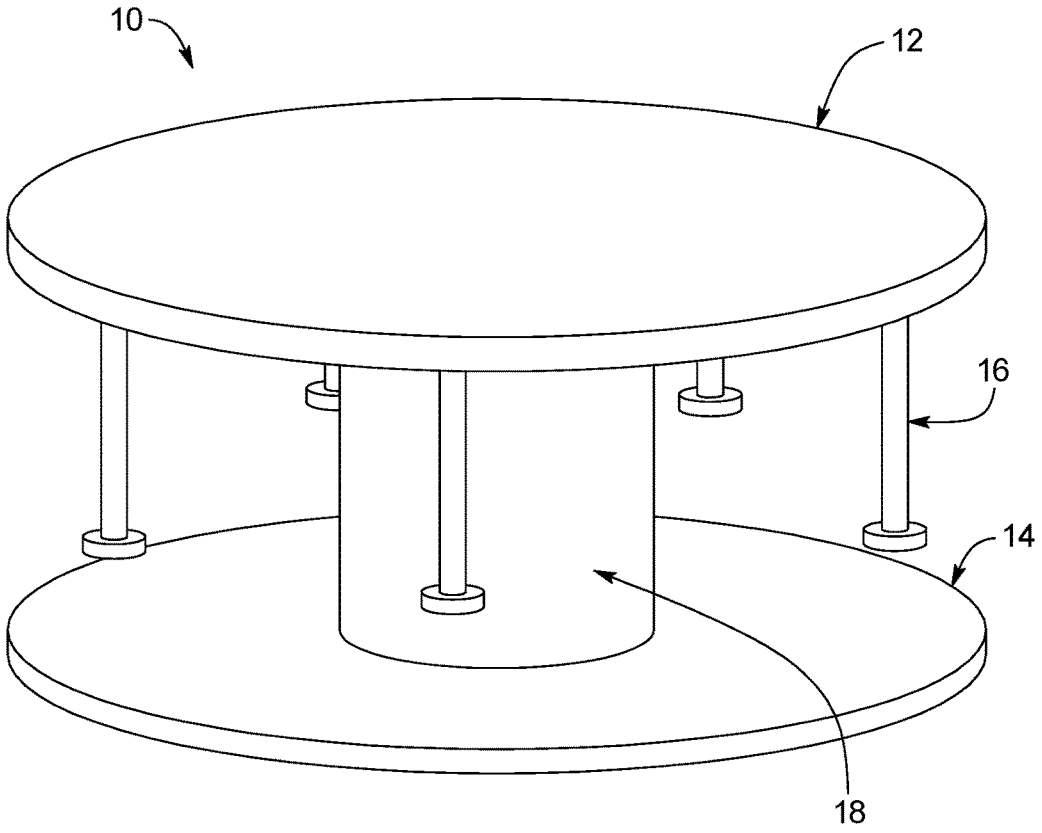
FIG. 1 PRIOR ART
FIG. 1 is a perspective view of a known bollard base.
Figure 2:
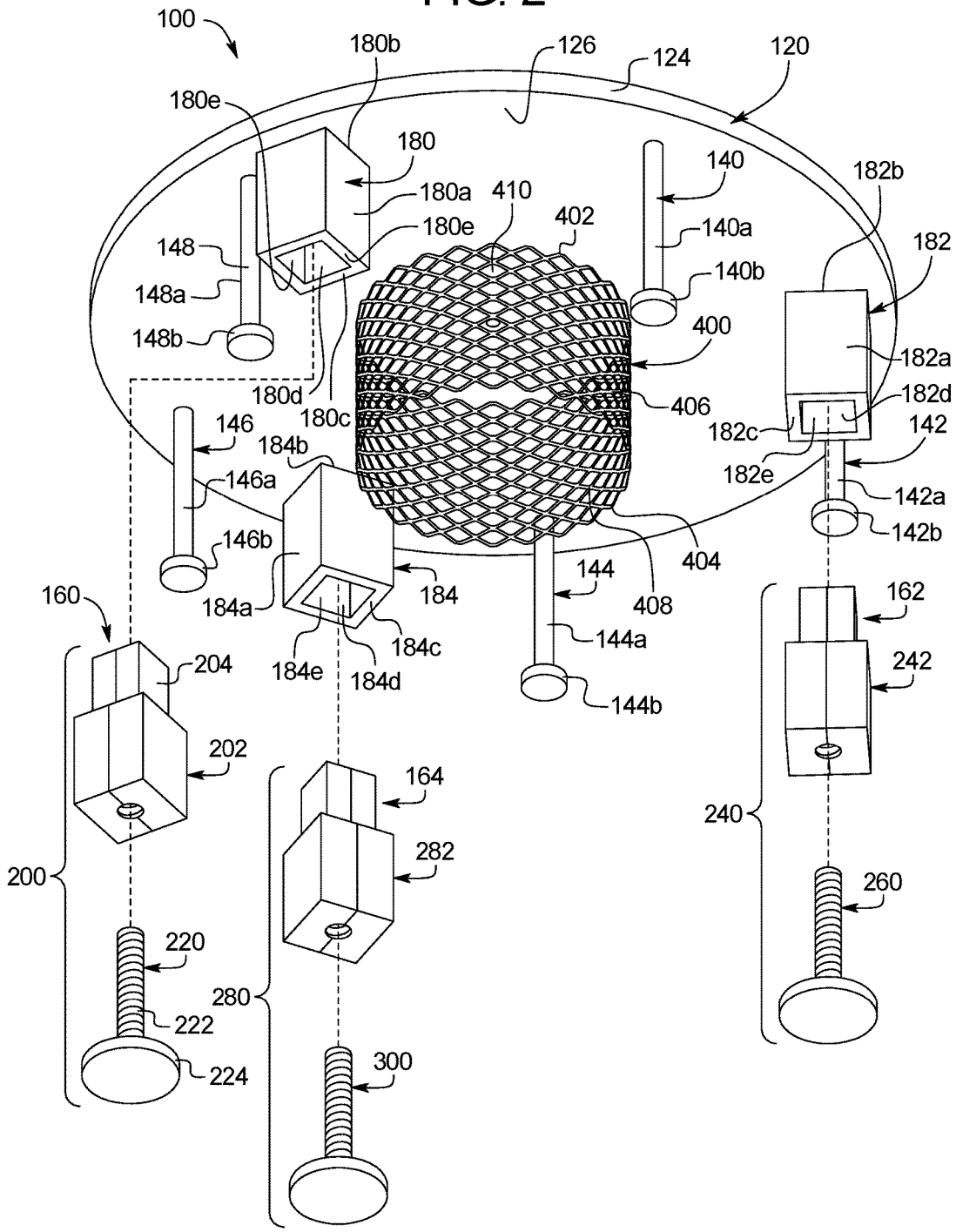
FIG. 2 is a bottom exploded perspective view of a bollard base of one embodiment of the present disclosure.

Referring now to FIGS. 2, 3, 4, 5, 6, and 8, one example embodiment of the bollard base of the present disclosure is generally illustrated and indicated by numeral 100. This illustrated example bollard base 100 generally includes: (1) a top plate 120; (2) a plurality of spaced-apart anchors 140, 142, 144, 146, and 148 each integrally connected to and extending downwardly from the top plate 120; (3) a plurality of adjustable leg assemblies 160, 162, and 164 (including a plurality of spaced-apart tubular legs 180, 182, and 184 integrally connected to and extending downwardly from the top plate 120, and a plurality of adjustable feet 200, 240, and 280 respectively partially removably insertable into the tubular legs 180, 182, and 184); and (4) a tubular baffle 400 integrally connected to and extending downwardly from the bottom of the top plate 120.

More specifically, the top plate 120 of the bollard base 100 has a typically cylindrical or substantially cylindrical body having a top surface 122, a side surface or edge 124, and a bottom surface 126. The body defines or has an air or pressure relief opening 128 extending though the body from the top surface 122 to the bottom surface 126. This air or pressure relief opening 128 enables air to escape from underneath the top plate 120 when concrete is poured and/or compacted around the bollard base 100, as further described below with respect to FIG. 8. It should be appreciated that the present disclosure contemplates the top plate having more than one air or pressure relief openings.

The top plate 120 is made from steel in this example embodiment, however it should be appreciated that the top plate can be made from other suitable materials in accordance with the present disclosure. The top plate 120 is cylindrical or substantially cylindrical in this example embodiment, however it should be appreciated that the top plate can be made having other suitable shapes in accordance with the present disclosure. One such alternative shape is a D shaped top plate.

The plurality of spaced-apart anchors 140, 142, 144, 146, and 148 of bollard base 100 are each integrally connected and each extend downwardly from the bottom surface 126 of the top plate 120. In this illustrated embodiment, each anchor has a cylindrical body or shaft and a base connected to the shaft. Specifically, anchor 140 includes shaft 140*a* and base 140*b*, anchor 142 includes shaft 142*a* and base 142*b*, anchor 144 includes shaft 144*a* and base 144*b*, anchor 146 includes shaft 146*a* and base 146*b*, and anchor 148 includes shaft 148*a* and base 148*b*. The anchors are engaged by the concrete to facilitate holding the bollard base 120 in place.

The anchors 140, 142, 144, 146, and 148 are made from steel and welded to the bottom surface 126 of the top plate 120 in this example embodiment. It should be appreciated that the anchors can be made from other suitable materials and attached to the top plate in other suitable manners in accordance with the present disclosure. It should also be appreciated that the anchors can be made having other suitable shapes in accordance with the present disclosure. It should further be appreciated that the quantity and/or positioning of the anchors can vary in accordance with the present disclosure. It should further be appreciated that in certain embodiments as further discussed below, the bollard base does not include such anchors in accordance with the present disclosure.

The plurality of adjustable leg assemblies 160, 162, and 164 of the bollard base 100 of this illustrated example embodiment include a plurality of spaced-apart tubular legs 180, 182, and 184 each integrally connected to and extending downwardly from the bottom surface 126 of the top plate 120 and a plurality of adjustable feet 200, 240, and 280 respectively partially removably insertable into the bottoms of the tubular legs as further described below. Each of these adjustable leg assemblies independently enables the height of part of the bollard base to be adjusted to account for sub-grade heights which are not in accordance with specifications, to account for uneven sub-grades, and to account for different concrete slab thicknesses. These adjustable leg assemblies also collectively enable the height of the bollard base to be adjusted to account for sub-grade heights which are not in accordance with specifications and to account for uneven sub-grades. These adjustable leg assemblies also collectively enable the height of the bollard base to be adjusted to account for different concrete slab thicknesses. It should be appreciated that the quantity and/or positioning of the leg assemblies can vary in accordance with the present disclosure.

More specifically, the adjustable leg assemblies 160, 162, and 164 of the bollard base 100 of this illustrated example embodiment include the plurality of spaced-apart tubular legs 180, 182, and 184 each integrally connected to and extending downwardly from the bottom surface 126 of the top plate 120. In this illustrated embodiment, each tubular leg is square, includes an outer surface, a top edge, a bottom edge, and an inner surface which defines a foot receiving chamber. Specifically: (1) tubular leg 180 includes outer surface 180*a*, top edge 180*b*, bottom edge 180*c*, and inner surface 180*d* which defines foot receiving chamber 180*e*, (2) tubular leg 182 includes outer surface 182*a*, top edge 182*b*, bottom edge 182*c*, and inner surface 182*d* which defines foot receiving chamber 182*e*, and (3) tubular leg 184 includes outer surface 184*a*, top edge 184*b*, bottom edge 184*c*, and inner surface 184*d* which defines foot receiving chamber 184*e*. The plurality of adjustable feet 200, 240, and 280 are respectively partially insertable into the foot receiving chambers 180*e*, 182*e*, and 184*e* of tubular legs 180, 182, and 184 as further described below.

The tubular legs 180, 182, and 184 are made from steel and are each welded to the bottom surface 126 of the top plate 120 in this illustrate example embodiment. It should be appreciated that the legs can be made from other suitable materials and attached to the top plate in other suitable manners in accordance with the present disclosure. The tubular legs 180, 182, and 184 in this illustrated example embodiment are shorter than the anchors. It should also be appreciated that the legs can be made having other suitable shapes and sizes (such as a triangular shape, an oval shape, other rectangular shapes, and other shapes having more than four sides) in accordance with the present disclosure. It should further be appreciated that the quantity and/or positioning of the legs can vary in accordance with the present disclosure.

The adjustable leg assemblies 160, 162, and 164 of the bollard base 100 of this illustrated example embodiment further include the plurality of adjustable feet 200, 240, and 280 that are respectively partially insertable into the receiving chambers 180*e*, 182*e*, and 184*e* of the tubular legs 180, 182, and 184. In this illustrated example embodiment, each of the adjustable feet includes: (a) a multi-level nut or toe receiver having a head receivable by or insertable into the receiving chamber of the tubular leg and a body extending below the tubular leg (when the head is inserted into the receiving chamber); and (b) a toe adjustably receivable in the nut or toe receiver. More specifically, (1) adjustable foot 200 includes multi-level nut or toe receiver 202 and adjustable toe 220; (2) adjustable foot 240 includes multi-level nut or toe receiver 242 and adjustable toe 260; (3) adjustable foot 280 includes multi-level nut or toe receiver 282 and adjustable toe 300, in this illustrated example embodiment. In this illustrated example embodiment, the adjustable leg assemblies each have the same configuration and size and the adjustable feet have the same configuration and size, and thus adjustable foot 200 including multi-level nut or toe receiver 202 and adjustable toe 220 is used herein as the example to further describe these components. It should be appreciated that the adjustable legs and adjustable feet can be made in other suitable manners and can have other suitable shapes in accordance with the present disclosure. It should further be appreciated that the quantity and/or positioning of adjustable legs and adjustable feet can vary in accordance with the present disclosure.

Figure 5:
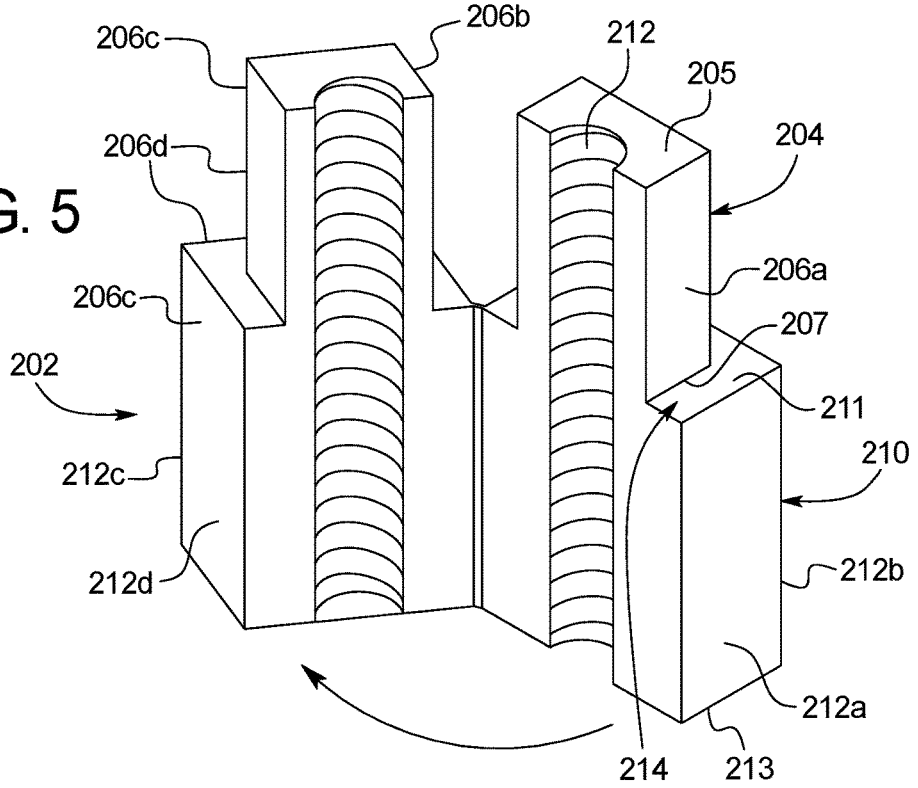
FIG. 5 is an enlarged perspective view of one of the adjustable feet of the bollard base of FIG. 2 shown in an open position.
Figure 6:
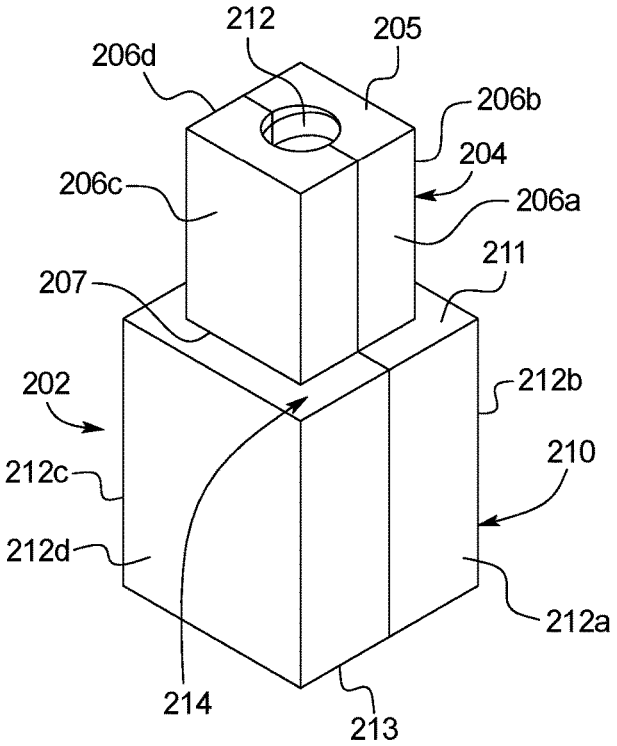
FIG. 6 is an enlarged perspective of one of the adjustable feet of the bollard based of FIG. 2 shown in a closed position.

As best shown in FIGS. 5 and 6, the multi-level nut or toe receiver 202 includes: (1) a head 204 having an upper surface 205; side surfaces 206*a*, 206*b*, 206*c*, and 206*d*; and a bottom edge or side 207; and (2) a body 210 having a top side 211; side surfaces 212*a*, 212*b*, 212*c*, and 212*d*; and a bottom side 213. In this illustrated example embodiment, the bottom side 207 of the head is integrally connected to the top side 211 of the body 210. It should be appreciated that the head and the body can alternatively be separately formed and suitably connected.

Figure 3:
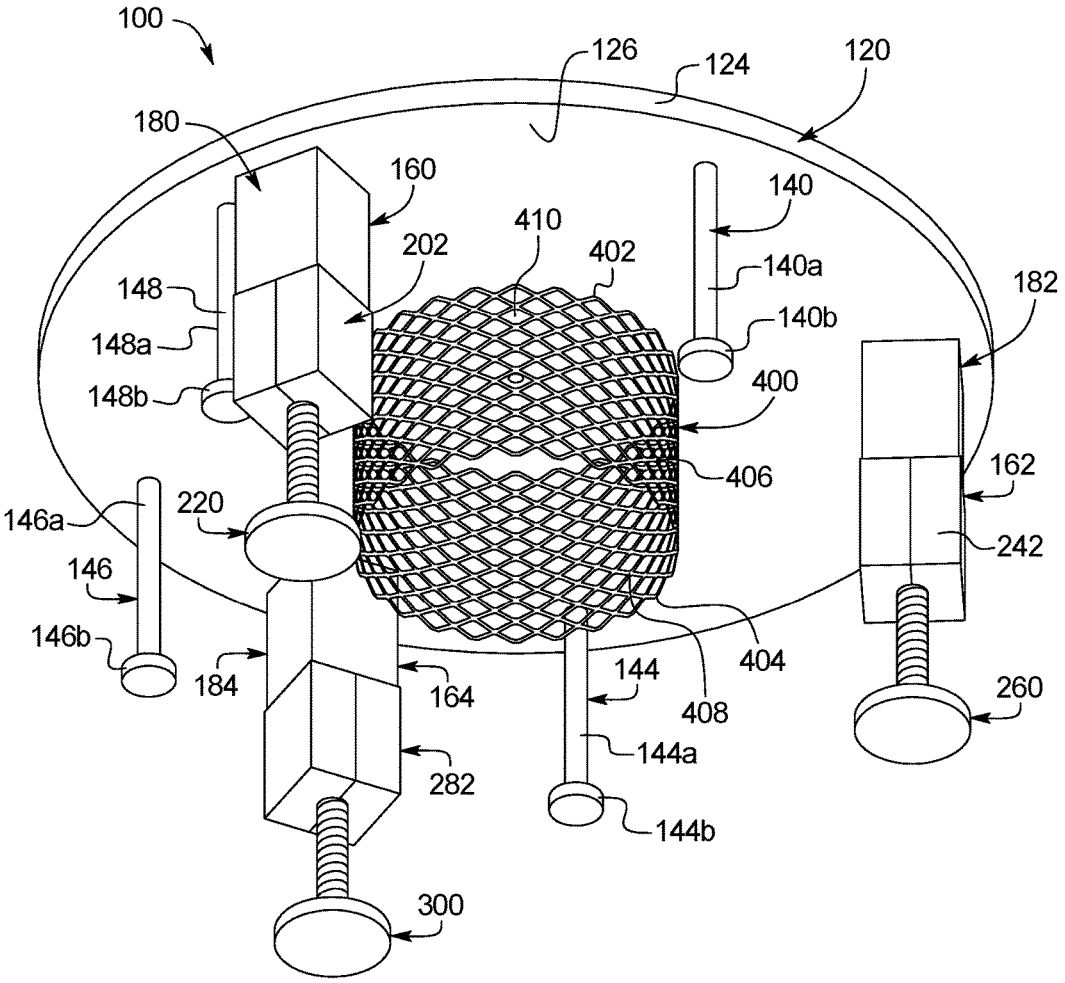
FIG. 3 is bottom perspective view of the assembled bollard base of FIG. 2.
Figure 4:
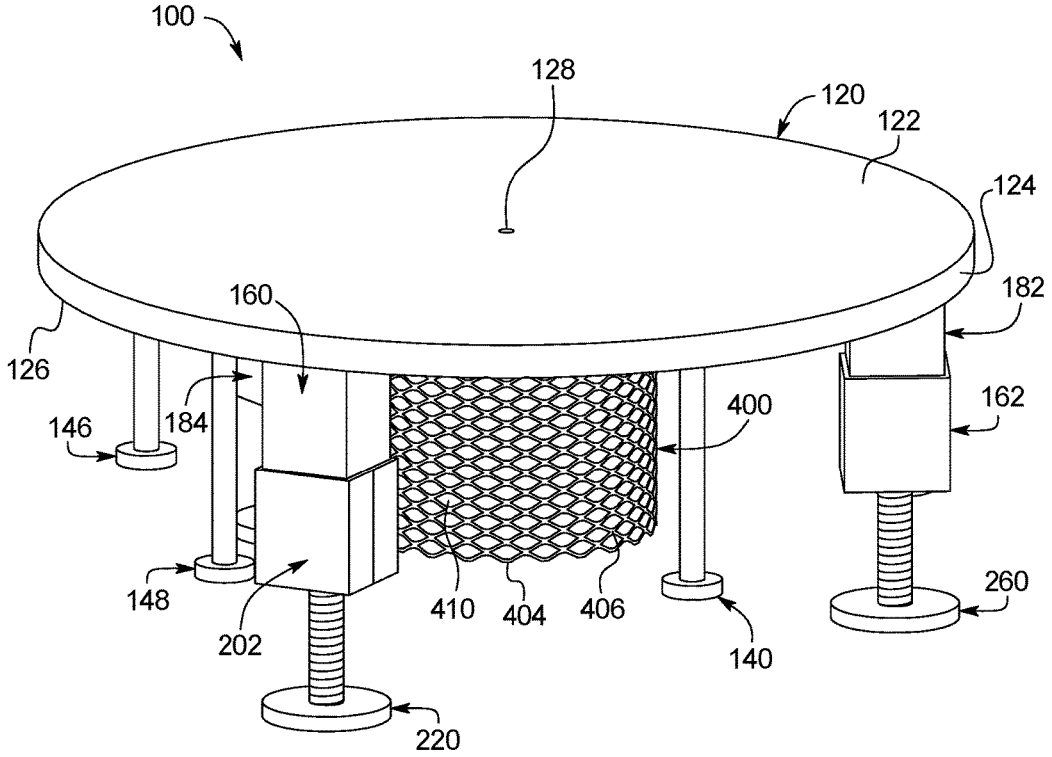
FIG. 4 is top perspective view of the assembled bollard base of FIG. 2.

The body 210 is bigger than the head 204 and, specifically, the width of the body 210 is greater than the width of the head 204 and the length of the body 210 is greater than the length of the head 204. This provides the multi-level configuration for the multi-level nut or toe receiver 202 and specifically the shoulder 214 formed by part of the top side 211 of the body 210. The shoulder 214 engages the bottom edge 180 of the tubular leg 180 (as illustrated in FIGS. 3 and 4), which prevents the nut 202 from moving further into the leg 180. The head 204 is sized to securely fit into the receiving chamber 180*e* of the leg 180. In one embodiment, the dimensions are such that the head 204 is press fit into the chamber 180*e* of the leg 180. In certain embodiments, the head 204 includes one or more lips or flanges (not shown) which assist in holding the head 204 securely in the chamber 180*e* of the leg 180. It should be appreciated that the engagement between the square head 204 in the inner surface 180*d* of the leg 162 which defines the square receiving chamber 180*e* prevents rotation of the head 204 relative to the leg 162.

The head 204 and the body 210 of the multi-level nut or toe receiver 202 define a cylindrical threaded opening 212 which rotatably and adjustably receives the toe 220.

The adjustable toe 220 includes a cylindrical threaded shaft 222 threadably and adjustably receivable in the cylindrical threaded opening of the head 204 and the body 210 of the multi-level nut or toe receiver 202. The adjustable toe 220 includes a base 224 integrally connected to the bottom of the cylindrical threaded shaft 222.

The multi-level nut or toe receivers 202, 242, and 282 are molded from a suitable plastic in this illustrated example embodiment. In one embodiment, the multi-level nut or toe receivers 202, 242, and 282 are made by molding in an open and shut mold. In one embodiment, each multi-level nut is formed in an open position (as generally illustrated in FIG. 5) and folded upon itself (as generally illustrated in FIG. 6) prior to insertion into the respective leg. In one embodiment the multi-level nut is folded upon itself and upon the respective toe prior to insertion into the respective leg. In certain embodiments the multi-level nut includes a securing mechanism, such as a latch, to hold the multi-level nut in the closed position. It should be appreciated that the multi-level nut or toe receivers can be made from other suitable materials and attached to the top plate in other suitable manners in accordance with the present disclosure. It should also be appreciated that the multi-level nut or toe receivers can be made having other suitable shapes in accordance with the present disclosure. It should further be appreciated that the quantity and/or positioning of the multi-level nut or toe receivers can vary in accordance with the present disclosure.

The adjustable toes 220, 260, and 280 are also molded from a suitable plastic in this example embodiment. It should be appreciated that the adjustable toes can be made from other suitable materials and attached to the top plate in other suitable manners in accordance with the present disclosure. It should also be appreciated that the adjustable toes can be made having other suitable shapes in accordance with the present disclosure. It should further be appreciated that the quantity and/or positioning of the adjustable toes can vary in accordance with the present disclosure.

It should be appreciated from the above that adjustable feet 200, 240 and 280 including the multi-level nut or toe receivers 202, 242, and 282 and the toes 220, 260, and 300 are independently and collectively adjustable to account for uneven sub-grades and sub-grades of varying height. It should be appreciated from the above that the corresponding toes of the adjustable feet 200, 240 and 280 will each be inserted (e.g., threaded) into the corresponding toe receivers of the adjustable feet 200, 240 and 280 a specific distance before the concrete is poured.

In one embodiment, the bollard base illustrated in FIGS. 2 to 6 and 8 includes anchors that are approximately 125 millimeters (or approximately 5 inches) long, tubular legs that are approximately 115 millimeters (or approximately 4.50 inches) long, adjustable feet (including the head and body) that are approximately 50 millimeters (or approximately 2 inches) long, and toes that are that are approximately 115 millimeters (or approximately 4.5 inches) long, which provide for height adjustments of in a range of approximately 125 millimeters (or approximately 5 inches) to approximately 215 millimeters (or approximately 8.5 inches).

Figure 7:
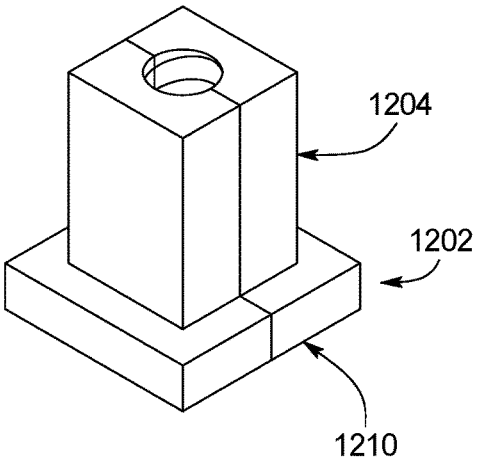
FIG. 7 is a perspective view of an alternative embodiment of one of the adjustable feet of the bollard base of the present disclosure and which shows a compacted tube.

As generally shown in FIG. 7, an alternative multi-level nut or toe receiver 1202 has a similar sized head 1204 to head 204, but has a smaller sized body 1210. It should thus be appreciated that sets of different sized multi-level nut or toe receivers (such as three multi-level nut or toe receivers 202 and three multi-level nut or toe receivers 1202) may be provided with the rest of the bollard base 100 to accommodate or account for different concrete thicknesses and different sub-grade levels.

The present disclosure further provides a method of adjusting the height of part or all of a bollard base which includes adjusting one or more of the toes relative to the heads to adjust the height of parts or all of the top plate of the bollard base. The present disclosure further provides a method of adjusting the height of the bollard base by selecting different size multi-level nut or toe receivers to adjust the height of the top plate of the bollard base. The present disclosure further provides a method of adjusting the height of part or all of a bollard base by selecting different size multi-level nut or toe receivers and adjusting one or more of the toes relative to the heads to adjust the height of parts or all of the top plate of the bollard base.

The tubular baffle 400 of the illustrated example bollard base is integrally connected to and extends downwardly from the bottom surface 126 of the top plate 120. The tubular baffle 400 includes a tubular body having a top edge 402, a bottom edge 404, an outer surface 406, and an inner surface 408. The body of the tubular baffle 400 defines a plurality of spaced apart openings 410.

The tubular baffle 400 in this illustrated embodiment is made from an expanded mesh steel and the top edge 402 of the baffle is welded to the bottom surface 126 of the top plate 120. It should be appreciated that the baffle can be made from other suitable materials and attached to the top plate in other suitable manners in accordance with the present disclosure. The tubular baffle in this example illustrated embodiment is shorter than the anchors. It should also be appreciated that the baffle can be made having other suitable shapes and sizes in accordance with the present disclosure. It should further be appreciated that the quantity and/or positioning of the baffle can vary in accordance with the present disclosure. It should be appreciated that the baffle can be made with alternative sized diameters or circumferences.

Figure 8:
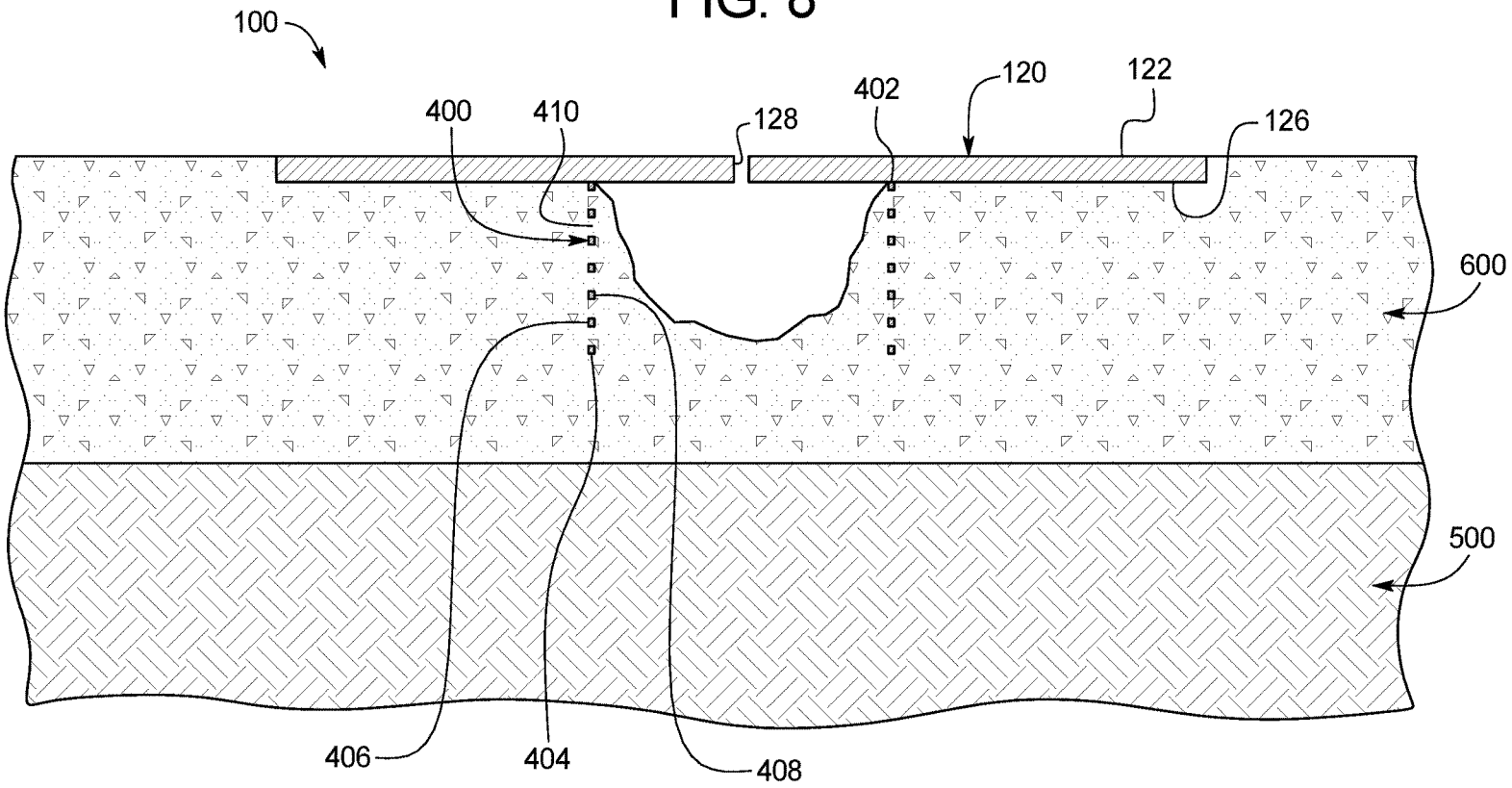
FIG. 8 is a cross sectional view of the bollard base of FIG. 2 shown fixed in a concrete slab.

As best illustrated in FIG. 8, the tubular baffle 400 enables the poured concrete 600 on the sub-grade 500 to flow through the spaced apart openings 410 in the baffle 400 to provide a more secure engagement between the bollard base 100 and the concrete 600. As the concrete flows from all sides to and through the tubular baffle 400, the trapped air will be able to flow through the air or pressure relief opening 128 extending though the body from the top surface 122 to the bottom surface 126 of the top plate 120.

It should be appreciated that the size, shape, quantity, and positioning of the openings in the baffle may vary in accordance with the present disclosure, in part depending on the desired flow rate of the concrete through the baffle.

In one embodiment, the bollard base illustrated in FIGS. 2 to 6 and 8 includes a tubular baffle that has a height of approximately 101.60 millimeters (approximately 4 inches).

The present disclosure further provides alternative methods for securing a bollard base to concrete such as by employing one of the following: (1) the anchors, the baffle, and the adjustable legs; (2) the anchors and the adjustable legs; (3) the anchors and the baffle; (4) the baffle and the adjustable legs; (5) the baffle; and (6) the adjustable legs.

The present disclosure provides various different or alternative embodiments of a bollard base such as: (1) a bollard base having a top plate and a plurality of adjustable leg assemblies partially integrally connected to the top plate; (2) a bollard base having a top plate, a plurality of adjustable leg assemblies partially integrally connected to the top plate, and at least one and preferably a plurality of spaced-apart anchors each connected to and extending downwardly from the top plate; (3) a bollard base having a top plate and a tubular baffle connected to and extending downwardly from the bottom surface of the top plate; (4) a bollard base having a top plate, a tubular baffle connected to and extending downwardly from the bottom surface of the top plate, and at least one and preferably a plurality of spaced-apart anchors each connected to and extending downwardly from the top plate; (5) a bollard base having a top plate, a tubular baffle connected to and extending downwardly from the bottom surface of the top plate, and at least one and a plurality of adjustable leg assemblies partially integrally connected to the top plate; and (6) a bollard base having a top plate, a tubular baffle connected to and extending downwardly from the bottom surface of the top plate, at least one and a plurality of adjustable leg assemblies partially integrally connected to the top plate, and a plurality of spaced-apart anchors each connected to and extending downwardly from the top plate.

Figure 9A:
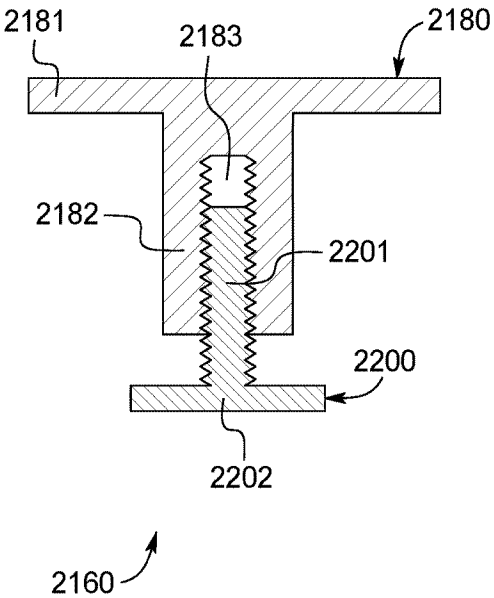
FIGS. 9A, 9B, and 9C are cross-sectional views of an alternative embodiment of one of the adjustable feet of the bollard base of the present disclosure.
Figure 9B:
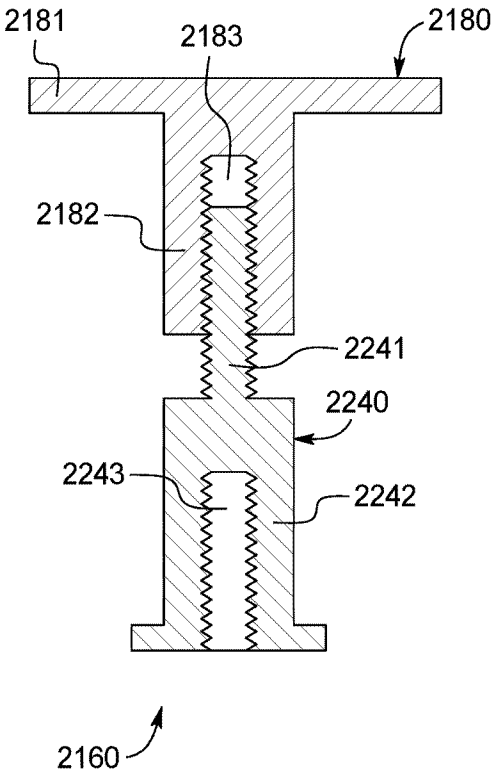
Figure 9C:
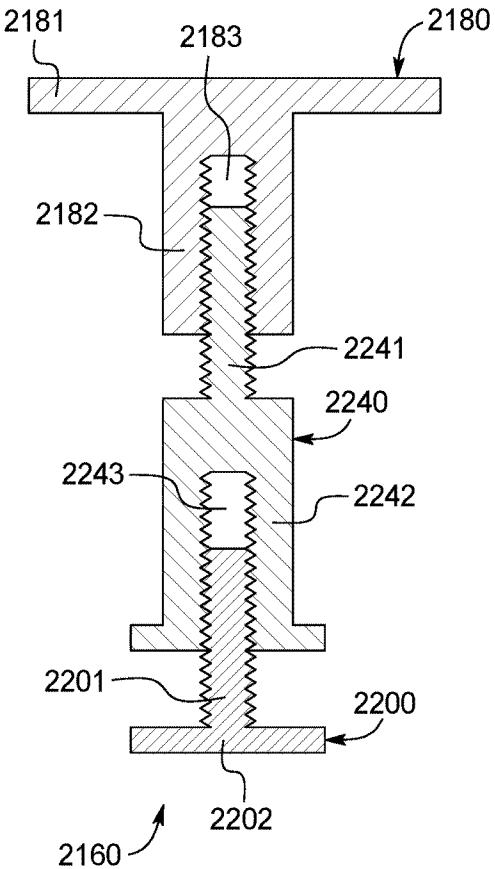

Referring now to FIGS. 9A, 9B, and 9C, an alternative example embodiment of the adjustable leg assembly of the bollard base of the present disclosure is generally illustrated and indicated by numeral 2160. The adjustable leg assembly 2160 of the bollard base of this illustrated example embodiment includes a leg 2180 integrally connected to and extending downwardly from the bottom surface of the top plate (not shown in FIGS. 9A, 9B, and 9C) and a plurality of different alternatively or interchangeably usable adjustable feet 2200 and 2240 respectively removably insertable into the bottom of the leg 2180 as further described below. The plurality of adjustable feet 2200 and 2240 are each independently usable with the leg 2160 as shown in FIGS. 9A and 9B to provide a plurality of different heights for the adjustable leg assembly 2160. The plurality of adjustable feet 2200 and 2240 are also usable together in combination with the leg 2180 as shown in FIG. 9C to provide a further plurality of different heights for the adjustable leg assembly 2160. This adjustable leg assembly independently enables the height of part of the bollard base to be adjusted to account for sub-grade heights which are not in accordance with specifications, to account for uneven sub-grades, and to account for different concrete slab thicknesses. A plurality of these adjustable leg assemblies also collectively enable the height of the bollard base to be adjusted to account for sub-grade heights which are not in accordance with specifications, to account for uneven sub-grades, and to account for different concrete slab thicknesses. It should be appreciated that the quantity and/or positioning of the leg assemblies can vary in accordance with the present disclosure.

More specifically, leg 2180 is configured to be integrally connected to and to extend downwardly from the bottom surface of the top plate (not shown in FIGS. 9A, 9B, and 9C). In this illustrated embodiment, leg 2180 includes a mounting base 2181 and an integrally formed tubular member 2182 extending downwardly from the mounting base 2181. The tubular member 2182 has an outer surface, a top edge integrally connected to the mounting base 2181, a bottom edge, and an inner threaded surface which defines a threaded foot receiving chamber 2183. The leg 2180 is made from steel and is welded to the bottom surface of the top plate in this example embodiment. It should be appreciated that the leg can be made from other suitable materials and attached to the top plate in other suitable manners in accordance with the present disclosure.

In this illustrated example embodiment, the adjustable foot 2200 is similar to the above described toes, and includes a threaded head 2201 adjustably receivable in the receiving chamber 2183 of the leg 2180, and a base 2202 integrally connected to the head 2201 as shown in FIGS. 9A and 9C. The foot 2200 is made from steel in this example embodiment. It should be appreciated that this foot can be made from other suitable materials and attached to the leg 2180 in other suitable manners in accordance with the present disclosure.

In this illustrated example embodiment, the adjustable foot 2240 includes a multi-level nut or toe receiver having a head 2241 receivable by or insertable into the receiving chamber 2183 of the leg 2180, and a body 2242 extending below the head 2241 as shown in FIGS. 9B and 9C. The body 2242 has an outer surface, a top edge integrally connected to the head 2241, a bottom edge, and an inner threaded surface which defines a threaded foot receiving chamber 2243. In this illustrated example embodiment, the adjustable foot 2200 is thus also adjustably receivable in the receiving chamber 2243 of the adjustable foot 2240 as shown in FIG. 9C. The foot 2240 is made from steel in this example embodiment. It should be appreciated that this foot can be made from other suitable materials and attached to the leg 2180 in other suitable manners in accordance with the present disclosure.

Although not shown, this bollard base can additionally include a plurality of spaced-apart anchors connected to and extending downwardly from the top plate. Although not shown, this bollard base can additionally include a tubular baffle connected to and extending downwardly from the bottom of the top plate.

Figure 10:
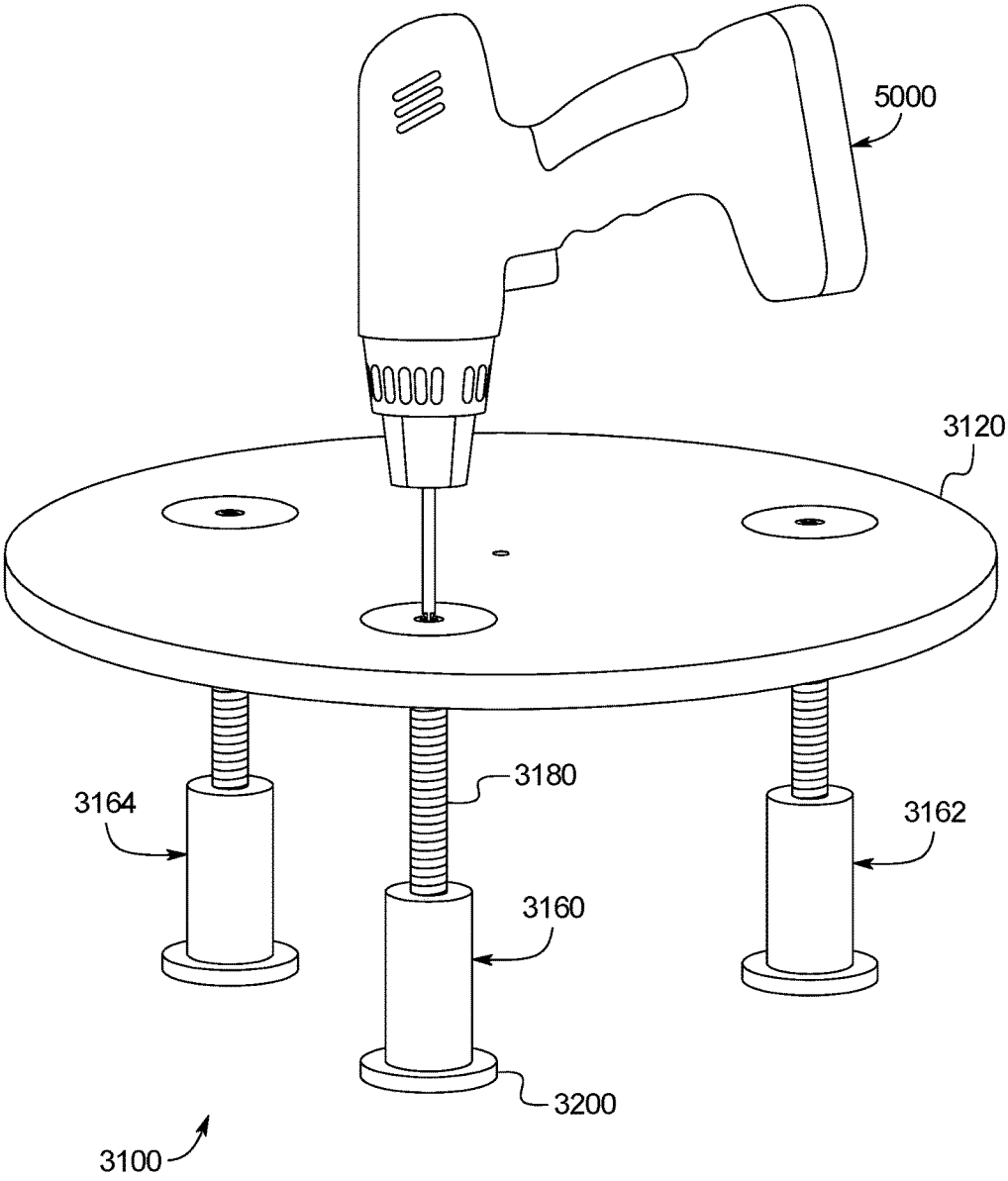
FIG. 10 is a top perspective view of an alternative embodiment of the bollard base of the present disclosure.

Referring now to FIG. 10, another example embodiment of the bollard base of the present disclosure is generally illustrated and indicated by numeral 3100. This illustrated example bollard base 3100 generally includes: (1) a top plate 3120; and (2) a plurality of adjustable leg assemblies 3160, 3162, and 3164. In this embodiment, the adjustable leg assemblies 3160, 3162, and 3164 are identical, although it should be appreciated that these adjustable leg assemblies do not need to be identical. For brevity, adjustable leg assembly 3160 is discussed herein. Adjustable leg assembly 3160 includes a leg 3180 rotatably connected to and extending downwardly from the bottom of the top plate 3120 and an adjustable foot 3200 connected to the leg 3180. The leg 3180 is rotatably received in the foot 3200 such that rotation of the leg 3180 (such as by tool 5000) causes the height of the foot 3200 to change relative to the top plate 3120. Each adjustable leg assembly independently enables the height of part of the bollard base to be adjusted to account for sub-grade heights which are not in accordance with specifications, to account for uneven sub-grades, and to account for different concrete slab thicknesses. A plurality of these adjustable leg assemblies also collectively enable the height of the bollard base to be adjusted to account for sub-grade heights which are not in accordance with specifications, to account for uneven sub-grades, and to account for different concrete slab thicknesses. It should be appreciated that the quantity and/or positioning of the leg assemblies can vary in accordance with the present disclosure.

Although not shown, this bollard base 3100 can additionally include a plurality of spaced-apart anchors connected to and extending downwardly from the top plate 3120. Although not shown, this bollard base 3100 can additionally include a tubular baffle connected to and extending downwardly from the bottom of the top plate 3120.

Figure 11:
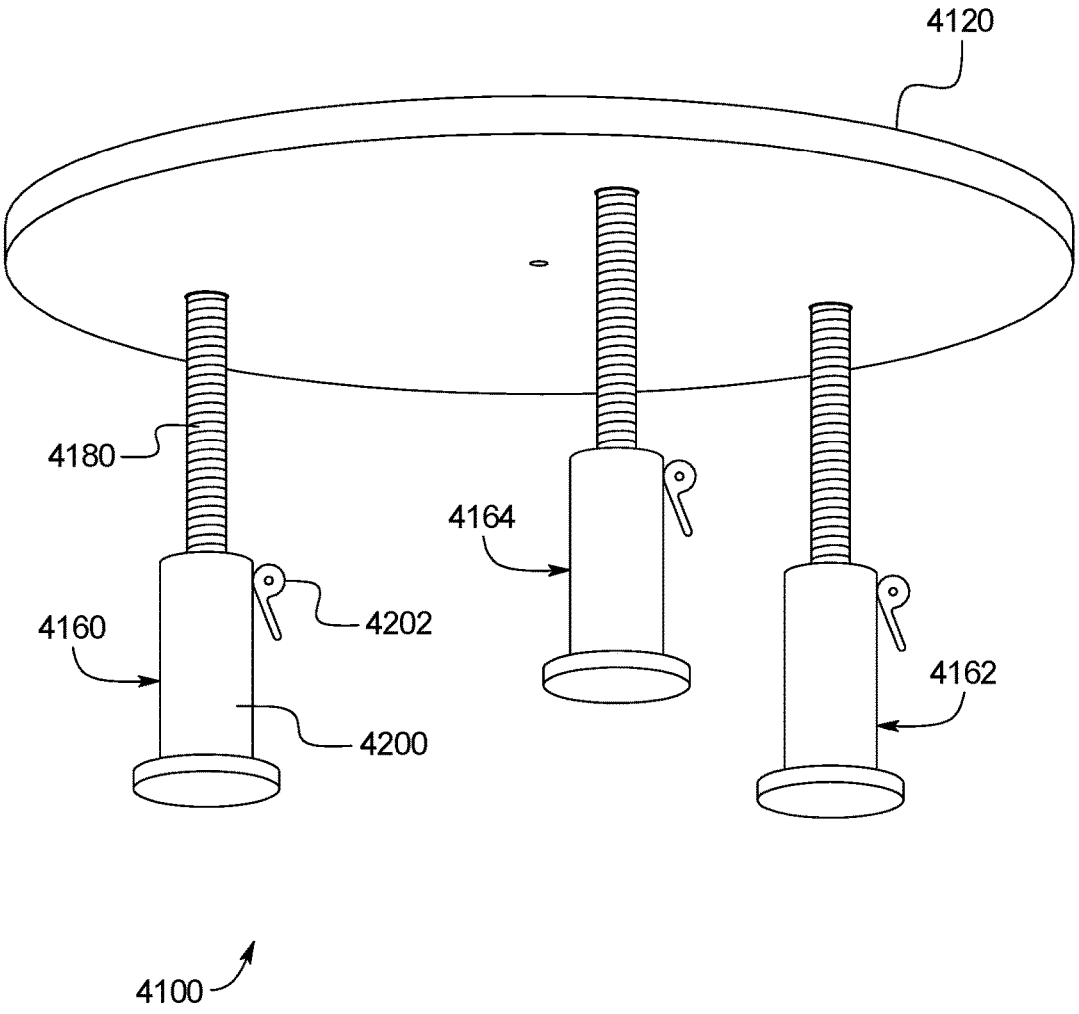
FIG. 11 is a bottom perspective view of another alternative embodiment of the bollard base of the present disclosure.

Referring now to FIG. 11, another example embodiment of the bollard base of the present disclosure is generally illustrated and indicated by numeral 4100. This illustrated example bollard base 4100 generally includes: (1) a top plate 4120; and (2) a plurality of adjustable leg assemblies 4160, 4162, and 4164. In this embodiment, the adjustable leg assemblies 4160, 4162, and 4164 are identical, although it should be appreciated that these adjustable leg assemblies do not need to be identical. For brevity, adjustable leg assembly 4160 is discussed herein. Adjustable leg assembly 4160 includes a leg 4180 integrally connected to and extending downwardly from the bottom of the top plate 4120 and an adjustable foot 4200 connected to the leg 4180. The leg 4180 is rotatably received in the foot 4200 such that rotation of the foot 4200 is rotatable with respect to the leg 4180. In this example embodiment, a suitable locking mechanism 4202 is employed to lock the foot 4200 relative to the leg 4180. Each adjustable leg assembly independently enables the height of part of the bollard base to be adjusted to account for sub-grade heights which are not in accordance with specifications, to account for uneven sub-grades, and to account for different concrete slab thicknesses. A plurality of these adjustable leg assemblies also collectively enable the height of the bollard base to be adjusted to account for sub-grade heights which are not in accordance with specifications, to account for uneven sub-grades, and to account for different concrete slab thicknesses. It should be appreciated that the quantity and/or positioning of the leg assemblies can vary in accordance with the present disclosure.

Although not shown, this bollard base 4100 can additionally include a plurality of spaced-apart anchors connected to and extending downwardly from the top plate 4120. Although not shown, this bollard base 4100 can additionally include a tubular baffle connected to and extending downwardly from the bottom of the top plate 4120.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A bollard base comprising:

a top plate made from steel and having a top surface, a bottom surface, and a side edge;

a plurality of anchors integrally connected to the bottom surface of the top plate inwardly of the side edge of the top plate and extending downwardly from the bottom surface of the top plate; and a plurality of adjustable leg assemblies partially integrally connected to the bottom surface of the top plate inwardly of the side edge of the top plate and extending downwardly from the bottom surface of the top plate, wherein at least one of the adjustable leg assemblies includes: (a) a tubular leg made from steel and integrally connected to the bottom surface of the top plate inwardly of the side edge of the top plate and extending downwardly from the bottom surface of the top plate; and (b) a foot made from plastic and partially insertable into the tubular leg.

2. The bollard base of claim 1, wherein each of the adjustable leg assemblies has an independently adjustable height.

3. The bollard base of claim 1, wherein the tubular leg defines a foot receiving chamber.

4. The bollard base of claim 3, wherein the foot is partially insertable into the foot receiving chamber defined by the tubular leg.

5. The bollard base of claim 4, wherein the foot includes: (a) a multi-level toe receiver having a head insertable into the foot receiving chamber defined by the tubular leg and having a body extendable from the head; and (b) a toe adjustably receivable in the multi-level toe receiver.

6. The bollard base of claim 5, wherein the body has a cross-sectional area larger than a cross sectional area of the head.

7. The bollard base of claim 5, wherein a width of the body is greater than a width of the head.

8. The bollard base of claim 5, wherein the body includes a shoulder configured to engage a bottom edge of the tubular leg.

9. The bollard base of claim 5, wherein the head and the body of the multi-level toe receiver define a cylindrical threaded opening that is configured to adjustably receive the toe.

10. The bollard base of claim 9, wherein the toe includes a cylindrical threaded shaft threadably and adjustably receivable in the cylindrical threaded opening defined by the head and the body of the multi-level toe receiver.

11. The bollard base of claim 10, wherein the toe includes a base connected to a bottom of the cylindrical threaded shaft.

12. The bollard base of claim 5, wherein the multi-level toe receiver is molded from a plastic.

13. The bollard base of claim 12, wherein the multi-level toe receiver includes two connected sections and is foldable upon itself.

14. The bollard base of claim 12, wherein the toe is molded from a plastic.

15. The bollard base of claim 1, which includes a tubular baffle integrally connected to the bottom surface of the top plate inwardly of the side edge of the top plate and extending downwardly from the bottom surface of the top plate.

16. The bollard base of claim 1, wherein at least one of adjustable leg assemblies includes: (a) a leg connected to the bottom surface of the top plate inwardly of the side edge of the top plate and extending downwardly from the bottom surface of top plate; and (b) one of a plurality of different interchangeably usable adjustable feet removably partially insertable into the bottom of the leg.

17. The bollard base of claim 16, wherein two of the plurality of different interchangeably usable adjustable feet are usable together in combination with the leg.

18. The bollard base of claim 17, wherein one of the plurality of different interchangeably usable adjustable feet is configured to be partially received in another one of the plurality of different interchangeably usable adjustable feet.

19. The bollard base of claim 1, wherein at least one of adjustable leg assemblies includes: (a) a leg rotatably connected to the bottom surface of the top plate inwardly of the side edge and extending downwardly from the bottom surface of the top plate; and (b) an adjustable foot configured to rotatably partially receive the leg.

20. The bollard base of claim 1, wherein at least one of adjustable leg assemblies includes: (a) a leg integrally connected to the bottom surface of the top plate inwardly of the side edge and extending downwardly from the bottom surface of the top plate; (b) an adjustable foot rotatably partially connected to the leg; and (c) a locking mechanism configured to lock the adjustable foot relative to the leg.

21. A bollard base comprising:

a top plate having a top surface, a bottom surface, and a side edge;

a plurality of anchors integrally connected to the bottom surface of the top plate inwardly of the side edge of the top plate, the anchors extending downwardly from the bottom surface of the top plate;

a plurality of adjustable leg assemblies partially connected to and extending downwardly from a bottom of the top plate, each adjustable leg assembly including:

(a) a tubular leg integrally connected to the bottom surface of the top plate inwardly of the side edge of the top plate and extending downwardly from the bottom surface of the top plate, the tubular leg defining a foot receiving chamber; and (b) a foot partially insertable into the foot receiving chamber defined by the tubular leg, the foot including:

(i) a multi-level toe receiver having a head insertable into the foot receiving chamber defined by the tubular leg and a body extending from the head, wherein the body includes a shoulder configured to engage a bottom edge of the tubular leg; and (ii) a toe adjustably receivable in the body of the multi-level toe receiver.

22. The bollard base of claim 21, wherein for each adjustable leg assembly, the head and the body of the multi-level toe receiver define a cylindrical threaded opening that is configured to adjustably receive the toe.

23. The bollard base of claim 21, wherein for each adjustable leg assembly, the adjustable toe includes a cylindrical threaded shaft threadably and adjustably receivable in the cylindrical threaded opening of the head and the body of the multi-level toe receiver.

24. The bollard base of claim 23, wherein for each adjustable leg assembly, the adjustable toe includes a base connected to a bottom of the cylindrical threaded shaft.

25. The bollard base of claim 24, wherein for each adjustable leg assembly, the multi-level toe receiver is molded from a plastic.

26. The bollard base of claim 25, wherein for each adjustable leg assembly, the multi-level toe receiver includes two connected sections and is foldable upon itself.

27. The bollard base of claim 26, wherein for each adjustable leg assembly, the toe is molded from a plastic.

28. The bollard base of claim 21, which includes a tubular baffle integrally connected to the bottom surface of the top plate inwardly of the side edge and extending downwardly from the bottom surface of the top plate.

29. A bollard base comprising:

a top plate having a top surface, a bottom surface, and a side edge;

a plurality of anchors integrally connected to the bottom surface of the top plate inwardly of the side edge of the top plate and extending downwardly from the bottom surface of the top plate; and a plurality of adjustable leg assemblies partially integrally connected to the bottom surface of the top plate inwardly of the side edge of the top plate and extending downwardly from the bottom surface of the top plate, wherein at least one of the adjustable leg assemblies includes: (a) a tubular leg integrally connected to the bottom surface of the top plate inwardly of the side edge of the top plate and extending downwardly from the bottom surface of the top plate, the tubular leg defining a foot receiving chamber; and (b) a foot partially insertable into the foot receiving chamber defined by the tubular leg, wherein the foot includes: (i) a multi-level toe receiver having a head insertable into the foot receiving chamber defined by the tubular leg and having a body extendable from the head, wherein a width of the body is greater than a width of the head; and (ii) a toe adjustably receivable in the multi-level toe receiver.

30. The bollard base of claim 29, wherein each of the adjustable leg assemblies has an independently adjustable height.

31. The bollard base of claim 29, wherein the body includes a shoulder configured to engage a bottom edge of the tubular leg.

32. The bollard base of claim 29, wherein the head and the body of the multi-level toe receiver define a cylindrical threaded opening that is configured to adjustably receive the toe.

33. The bollard base of claim 29, which includes a tubular baffle integrally connected to the bottom surface of the top plate inwardly of the side edge of the top plate and extending downwardly from the bottom surface of the top plate.

34. A bollard base comprising:

a top plate having a top surface, a bottom surface, and a side edge;

a plurality of anchors integrally connected to the bottom surface of the top plate inwardly of the side edge of the top plate and extending downwardly from the bottom surface of the top plate; and a plurality of adjustable leg assemblies partially integrally connected to the bottom surface of the top plate inwardly of the side edge of the top plate and extending downwardly from the bottom surface of the top plate, wherein at least one of adjustable leg assemblies includes: (a) a leg connected to the bottom surface of the top plate inwardly of the side edge of the top plate and extending downwardly from the bottom surface of top plate; and (b) one of a plurality of different interchangeably usable adjustable feet removably partially insertable into the bottom of the leg, and wherein two of the plurality of different interchangeably usable adjustable feet are usable together in combination with the leg.

35. The bollard base of claim 34, wherein one of the plurality of different interchangeably usable adjustable feet is configured to be partially received in another one of the plurality of different interchangeably usable adjustable feet.

36. The bollard base of claim 34, wherein each of the adjustable leg assemblies has an independently adjustable height.

37. The bollard base of claim 34, which includes a tubular baffle integrally connected to the bottom surface of the top plate inwardly of the side edge of the top plate and extending downwardly from the bottom surface of the top plate.

38. A bollard base comprising:

a top plate having a top surface, a bottom surface, and a side edge;

a plurality of anchors integrally connected to the bottom surface of the top plate inwardly of the side edge of the top plate and extending downwardly from the bottom surface of the top plate; and a plurality of adjustable leg assemblies partially integrally connected to the bottom surface of the top plate inwardly of the side edge of the top plate and extending downwardly from the bottom surface of the top plate, wherein at least one of the adjustable leg assemblies includes: (a) a tubular leg integrally connected to the bottom surface of the top plate inwardly of the side edge of the top plate and extending downwardly from the bottom surface of the top plate, wherein the tubular leg defines a foot receiving chamber; and (b) a foot partially insertable into the foot receiving chamber defined by the tubular leg, wherein the foot includes: (a) a multi-level toe receiver having a head insertable into the foot receiving chamber defined by the tubular leg and having a body extendable from the head; and (b) a toe adjustably receivable in the multi-level toe receiver, wherein the body has a cross-sectional area larger than a cross sectional area of the head.

39. The bollard base of claim 38, wherein each of the adjustable leg assemblies has an independently adjustable height.

40. The bollard base of claim 38, wherein the multi-level toe receiver is molded from a plastic.

41. The bollard base of claim 40, wherein the multi-level toe receiver includes two connected sections and is foldable upon itself.

42. The bollard base of claim 38, which includes a tubular baffle integrally connected to the bottom surface of the top plate inwardly of the side edge of the top plate and extending downwardly from the bottom surface of the top plate.

* * * * *